US006042060A

United States Patent [19]

Sargis

[11] Patent Number: 6,042,060

[45] Date of Patent: Mar. 28, 2000

[54] SOLAR-POWERED ELECTRICAL SWITCH STAND

[76] Inventor: Isaac Sargis, 6532 Albert Ave., Mortongrove, Ill. 60053

[21] Appl. No.: 09/052,307

[22] Filed: Mar. 31, 1998

[51] Int. Cl.[7] ..... B61L 5/00

[52] U.S. Cl. ..... 246/221; 246/406; 246/263

[58] Field of Search ..... 246/393, 406, 246/407, 221, 410, 411, 412, 476, 263

[56] References Cited

U.S. PATENT DOCUMENTS

| | | | |
|---|---|---|---|
| 140,917 | 7/1873 | Hanchett . | |
| 175,423 | 3/1876 | Chambers . | |
| 321,107 | 6/1885 | Hilburn et al. . | |
| 378,025 | 2/1888 | Tracy . | |
| 383,654 | 5/1888 | Pollock . | |
| 406,500 | 7/1889 | Boyd . | |
| 774,004 | 11/1904 | Strom . | |
| 823,647 | 6/1906 | Thomson . | |
| 856,336 | 6/1907 | Carter . | |
| 885,160 | 4/1908 | Kidd . | |
| 907,114 | 12/1908 | Anderson . | |
| 945,147 | 1/1910 | York . | |
| 993,089 | 5/1911 | McGuire . | |
| 1,024,279 | 4/1912 | Osburn . | |
| 1,031,404 | 7/1912 | Wenrich . | |
| 1,140,965 | 5/1915 | Dubois et al. . | |
| 1,169,106 | 1/1916 | Anderson . | |
| 1,278,623 | 9/1918 | Fleagle . | |
| 1,318,767 | 10/1919 | Kimack . | |
| 1,391,208 | 9/1921 | Partington . | |
| 1,418,127 | 5/1922 | Cesar . | |
| 1,478,888 | 12/1923 | Butler . | |
| 1,799,008 | 3/1931 | Dougherty . | |
| 1,889,022 | 11/1932 | Little . | |
| 1,908,781 | 5/1933 | Neeson . | |
| 2,045,930 | 6/1936 | Taylor | 246/393 |
| 2,559,477 | 7/1951 | Stephenson | 246/406 |
| 2,610,291 | 9/1952 | McGarry | 246/401 |
| 3,652,849 | 3/1972 | Kleppick | 246/393 |
| 4,275,525 | 6/1981 | Geisler et al. | 46/39 |
| 4,337,914 | 7/1982 | Rich | 246/428 |
| 5,052,642 | 10/1991 | Peters | 246/393 |
| 5,062,028 | 10/1991 | Frost et al. | 362/183 |
| 5,074,811 | 12/1991 | Crisman | 440/6 |
| 5,152,601 | 10/1992 | Ferng | 362/183 |
| 5,470,035 | 11/1995 | Sargis | 246/221 |
| 5,642,870 | 7/1997 | Sargis | 246/406 |
| 5,775,647 | 7/1998 | Wyatt | 246/393 |

FOREIGN PATENT DOCUMENTS

| | | |
|---|---|---|
| 14247 | 7/1895 | United Kingdom . |
| 16142 | 7/1904 | United Kingdom . |

OTHER PUBLICATIONS

One page of drawings (Figures 1–7) of British Patent No. 5459, Snell's. (no date).

*Primary Examiner*—Mark T. Le
*Attorney, Agent, or Firm*—Brinks Hofer Gilson & Lione

[57] ABSTRACT

A solar-powered, electric railroad switch stand includes a housing having a mounting mechanism for mounting a solar cell assembly for converting solar energy into electrical current, a storage battery, and a motor connected to a gear reduction mechanism having an output shaft extending therefrom. The battery stores a charge from the electrical current of the solar cells and is electrically coupled to the motor to drive a gear reduction mechanism. An operating device is linked to the output shaft and is operable to move the switching rails.

20 Claims, 13 Drawing Sheets

SOLAR-POWERED ELECTRICAL SWITCH STAND

FIELD OF THE INVENTION

This invention relates to railroad switching devices and particularly to electrically powered railroad switch stands.

BACKGROUND OF THE INVENTION

Railroad yards generally have manually and/or automatically operated switching devices for switching railroad cars from one track to another. These switching devices are well known in the art and have been described, for example, in U.S. Pat. Nos. 3,652,849 and 4,337,914 both incorporated by reference herein and made a part hereof.

Generally, a pair of stationary rails and a pair of switching rails are arranged so that the switching rails can be moved to keep trains on a main track or divert them to a branch track. The switching rails are moved by a switching device which includes a connecting rod that extends beneath the tracks to connections with the switching rails.

The switching devices typically include a switch stand to one side of the rails which can be operated either manually or automatically. When operated by hand, the switch is moved to a switch point by throwing a lever arm 180 degrees. For example, in the prior art, a weighted lever arm lying horizontally on the ground or at the base of the switch stand is lifted and thrown 180 degrees to the opposite side of the switch stand where it rests again horizontally on the ground or base. The weight and horizontal position of the lever arm prevents bouncing and accidental repositioning of the switch which could cause derailment. However, due to the large arc of throwing the lever arm and the amount of force and bending over required to carry out this operation, many switchmen have experienced back compression and resulting back and leg injuries.

To assist switchmen, electric motorized railroad switch stands have been provided for moving the switching rails of a railroad track. Such a switch stand is illustrated and described in U.S. Pat. No. 5,470,035, issued Nov. 28, 1995 by the same inventor named herein and assigned to the same entity. The electrical switch stand utilizes an electric motor and a gearing system to drive an actuator linked to the switching rails on the railroad track. The electric motor is powered by conventional alternating current and should therefore be connected to a continuous power source.

In many cases, however, switch stands must be installed in remote areas that do not have an available power source. Electric switch stands may be impossible or impractical to install in these areas, because even if power sources are available, it can be prohibitively expensive to install power links to the source and maintain service with a power supply utility.

It is, therefore, an object of the present invention to provide an improved electrical railroad switch stand which can be installed and used in remote areas away from continuous power sources.

It is another object of the present invention to provide an electrical railroad switch stand that utilizes a self-contained power source.

Other objects and advantages of the present invention will become apparent during the following detailed description, taken in conjunction with the accompanying drawings.

SUMMARY OF THE INVENTION

The present invention eliminates the foregoing disadvantages in the art of railroad switch stands by providing an electrical railroad switch stand for moving switching rails of a railroad track including a switching device for switching rails of a railroad track.

In one aspect of the present invention, a switch stand is provided which utilizes a solar cell assembly to charge a self-contained battery system. The switch stand includes a housing having a mounting means for mounting a solar cell assembly for converting solar energy into electrical current, a storage battery, and a motor connected to a gear reduction means having an output shaft extending therefrom. The battery stores a charge from the electrical current of the solar cells and is electrically coupled to the motor to drive a gear reduction means. An operating means is linked to the output shaft and is operable to move the switching rails.

In another aspect of the invention, a method for moving switching rails of a railroad track is provided including the steps of providing a motorized switching means including an electric motor and at least one control switch connected to the motor, providing a rechargeable battery means electrically coupled to the motorized switching means, providing a solar cell means electrically coupled to the battery means for supplying power to the battery means, charging the battery means using the solar cell means, and triggering the control switch to energize the motor to cause the switching means to move the switching rails.

DETAILED DESCRIPTION OF THE PREFERRED EMBODIMENT

Figure 1:
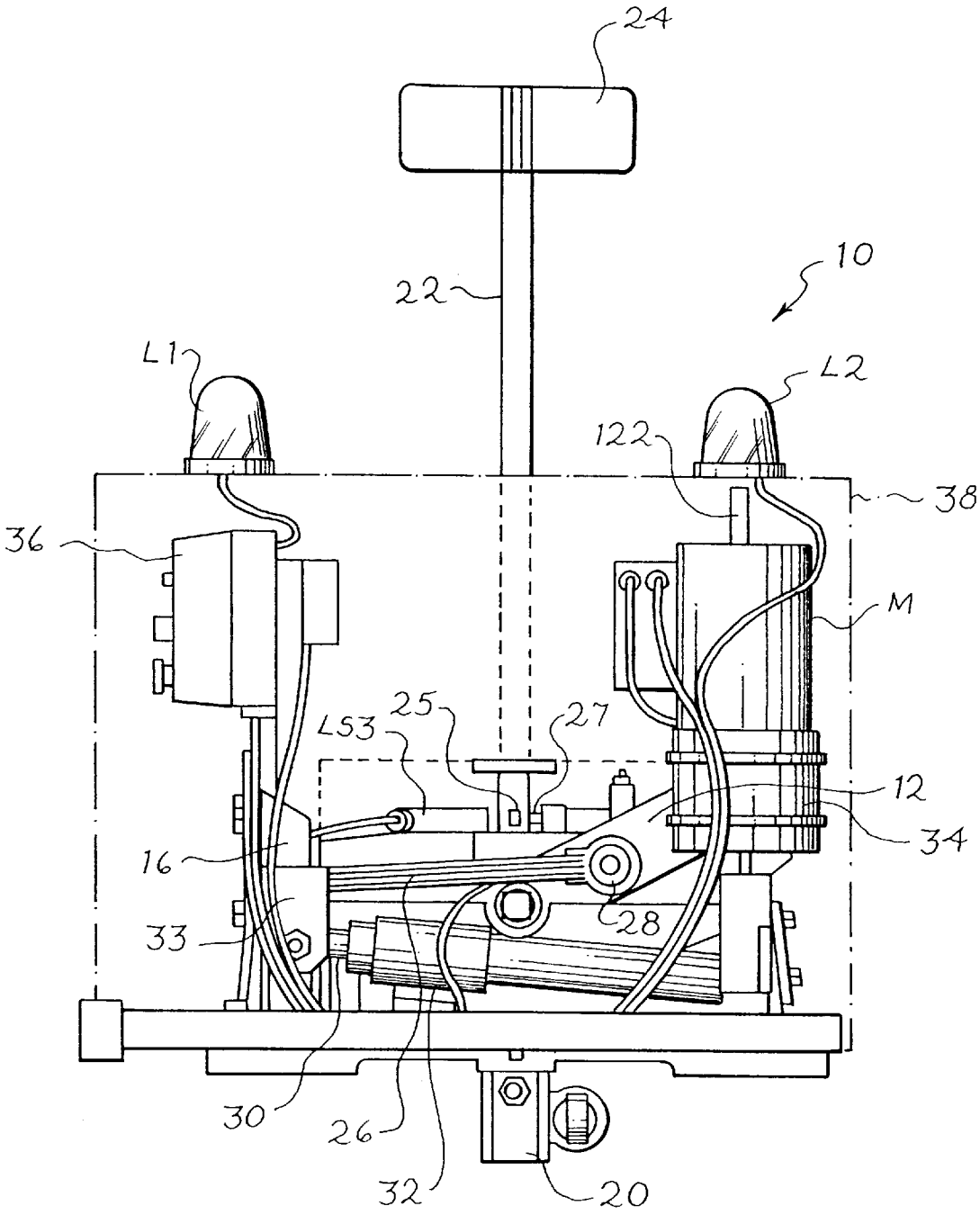
Fig. 1 (PRIOR ART)
FIG. 1 is a front elevational view of an electrical switch stand utilized in the embodiment of the present invention in one operational state.
Figure 2:
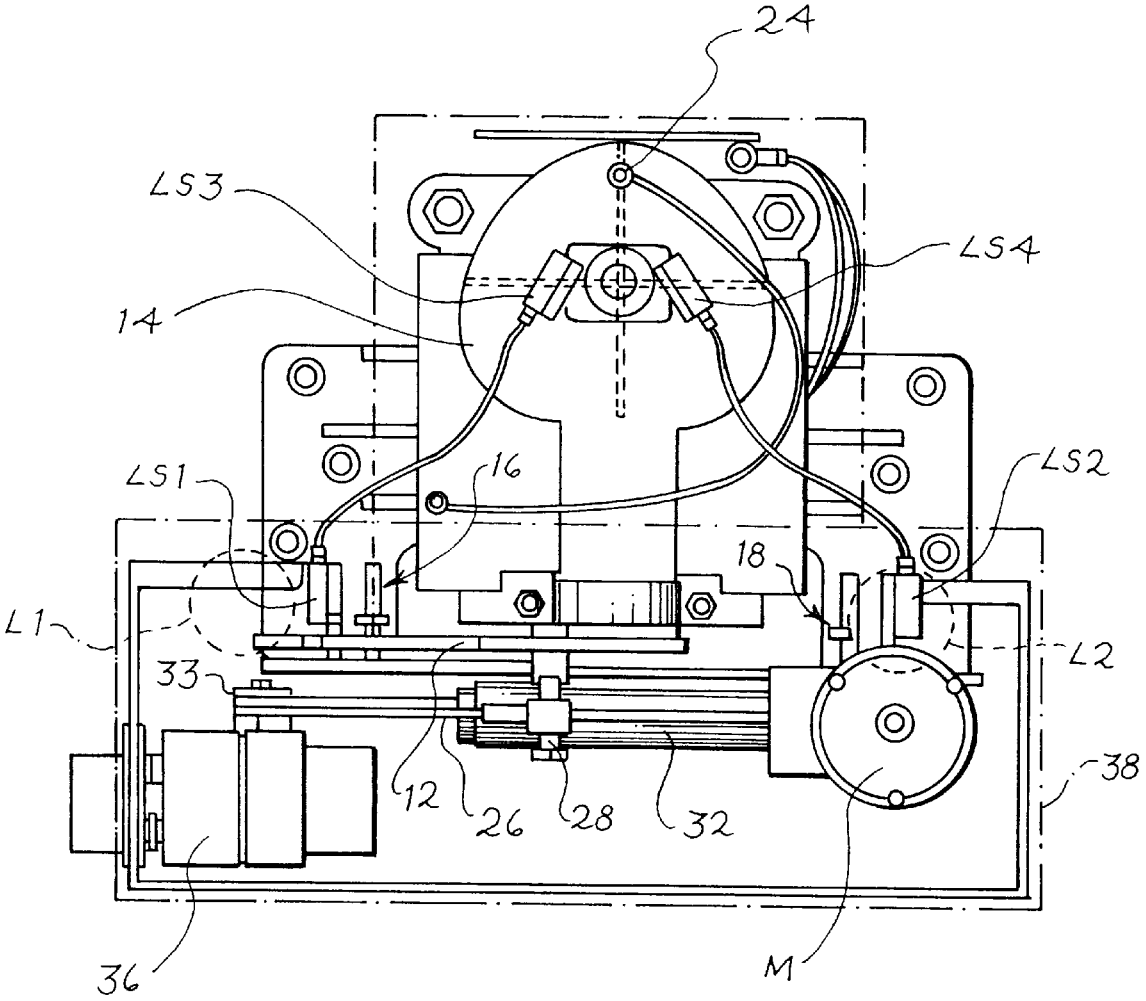
Fig. 2 (PRIOR ART)
FIG. 2 is a top view of electrical switch stand of FIG. 1.
Figure 3:
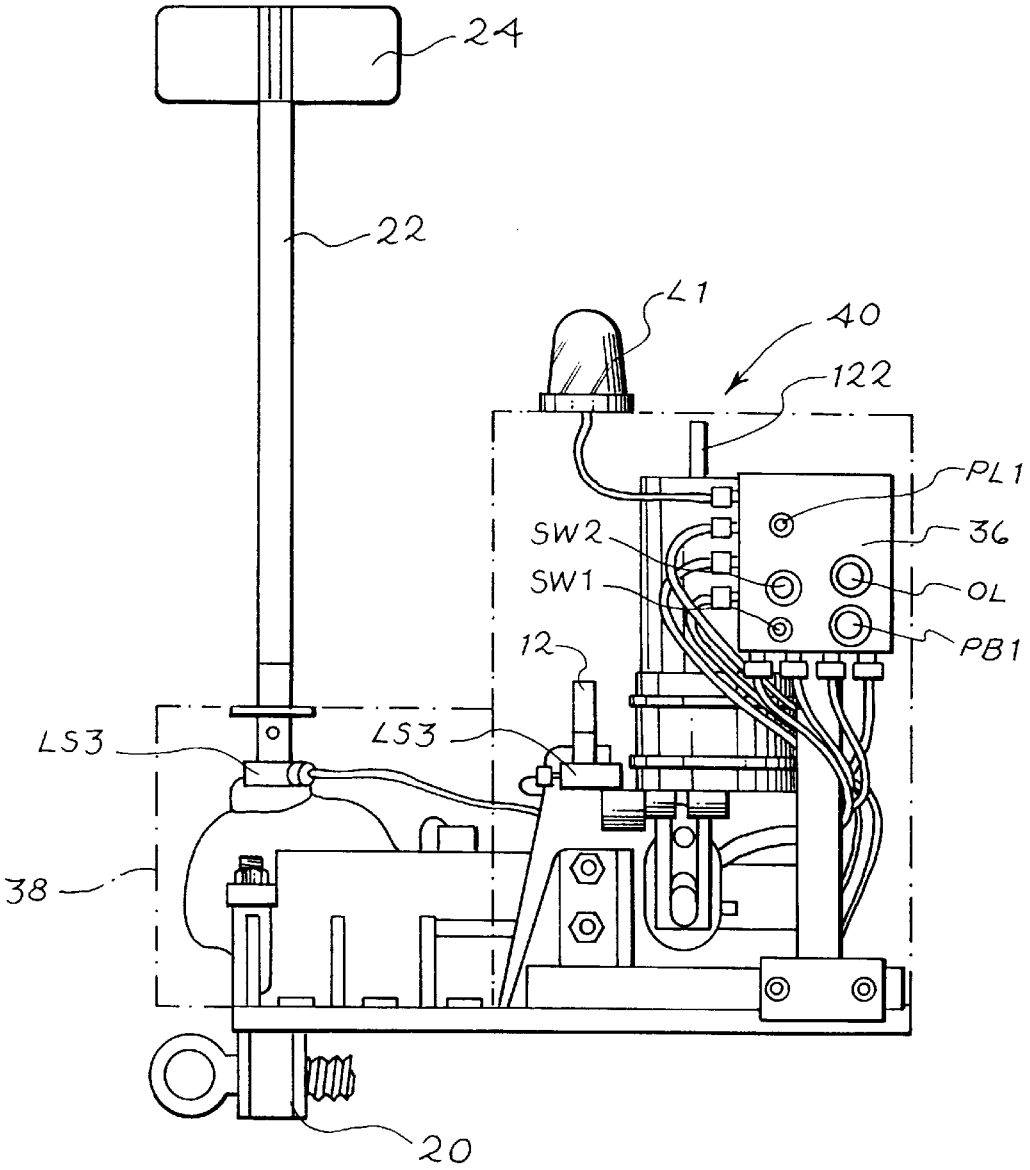
Fig. 3 (PRIOR ART)
FIG. 3 is a left side view of the electrical switch stand of FIG. 1.
Figure 4:
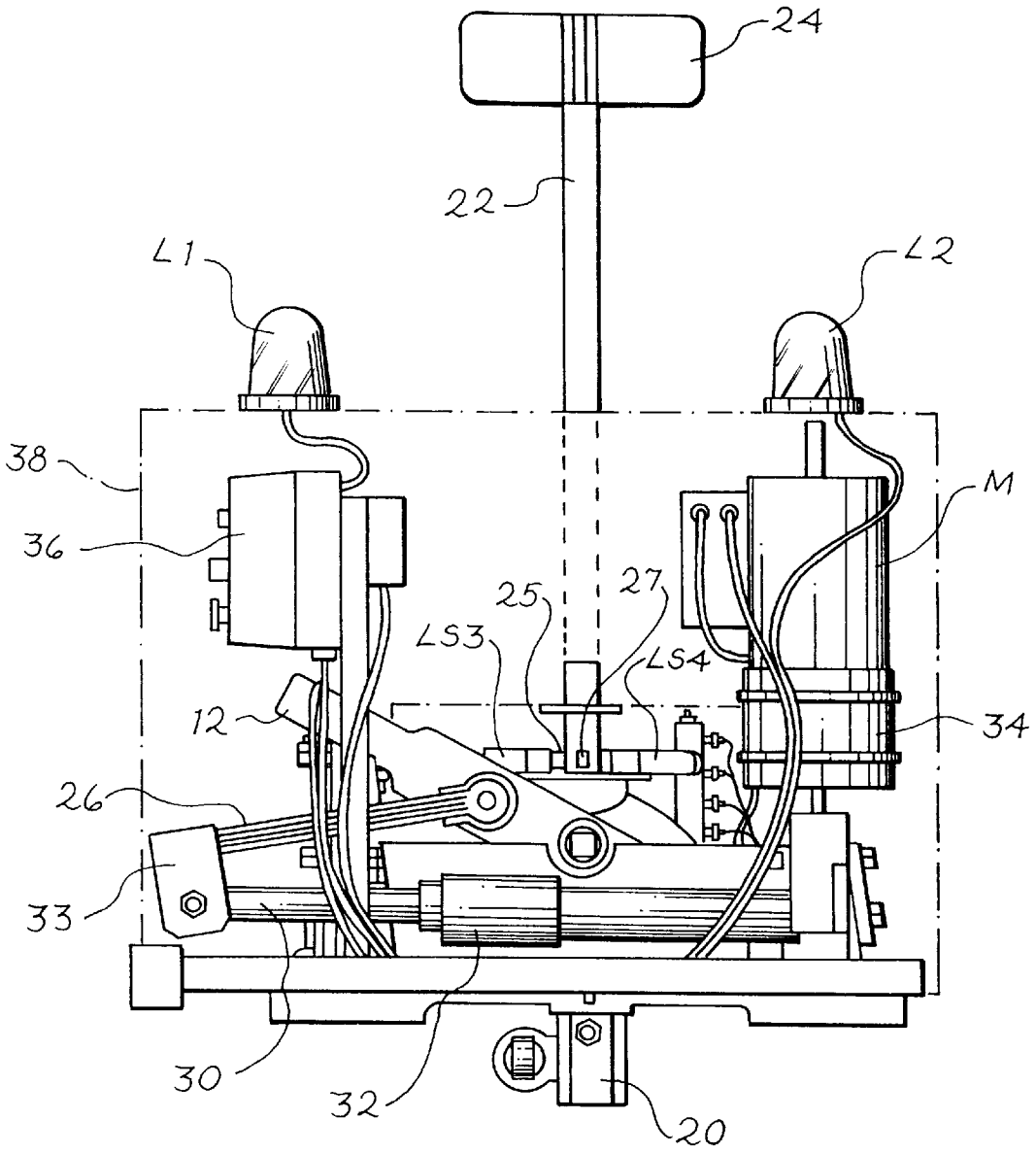
Fig. 4 (PRIOR ART)
FIG. 4 is a front elevational view of the electrical switch stand of FIG. 1 in another operational state.

FIGS. 1, 2, 3 and 4 show one embodiment of a switch stand that may be utilized with the present invention. An electrical switch stand 10 includes a switch handle 12 movable between a first position, as shown in FIG. 4 and a second position, as shown in FIG. 1. Cradle 16 supports handle 12 when it is in the first position and cradle 18 supports handle 12 when it is in the second position. The arc defined by the movement of handle 12 between the first position and the second position is preferably less than 120 degrees, although greater arcs may also be used. Cradles 16 and 18 preferably support handle 12 at an angle of 40 to 45 degrees with respect to the surface on which switch stand 10 rests.

Movement of handle 12 from the first position to the second position operates a conventional switching mechanism 14. Any type of conventional railroad track switching mechanism may be used. Preferably a direct mechanical throw action switch of the type manufactured and sold by National Trackwork, Inc. 1500 Industrial Drive, Itasca, Ill. as model number 1003A, is used. However, other types of conventional switching mechanisms may also be used, including those employing a gear ratio action. Switching mechanism 14 operates to move a conventional connecting rod 20 secured by conventional means to a pair of switch points on a pair of alternative railroad tracks. When the handle 12 is in the first position resting in cradle 16, a train moves along one set of tracks, and when the handle 12 is in the second position in cradle 18, a train moves along a second set of tracks. Normally closed limit switch LS1 is located at cradle 16 and normally closed limit switch LS2 is located at cradle 18. When handle 12 rests on cradle 16, limit switch LS1 is opened and when handle 12 rests on cradle 18, limit switch LS2 is opened.

As is conventional in the art, a shaft 22 extends upwardly from the switching mechanism 14. A target 24 is fixedly attached to shaft 22 and preferably includes four plates mounted at 90 degree intervals. Two plates are of a first color and two are of a second color. Two plates located in the same plane are matched so as to be of the same color. As the switching mechanism 14 acts to switch tracks, shaft 24 rotates, thus causing target 24 to rotate. In a preferred embodiment, shaft 22 and target 24 rotate 90 degrees as the handle 12 is moved between the first and second positions. The intersecting colored plates are fixed to shaft 22 such that the target 24 will show a single color to those viewing the target 24 from the front and from the rear when the switch handle 12 is in either the first position or the second position, i.e., when the connecting tracks are switched a first way or a second way. The color corresponding to the first position will be different from the color corresponding to the second position. Preferably the two colors used are green and yellow, although other colors may also be used. In this way the position of the tracks may be readily determined by viewing the target 24. Extension 25 and 27 extend from the base of shaft 22 and selectively engage normal closed limit switches LS3 and LS4, respectively, as shaft 22 rotates.

Motor M is a conventional AC-powered motor, preferably ½ horsepower, 1140 RPM. Motor shaft 122 extends above motor M and below motor M into motor brake 34.

Figure 5:
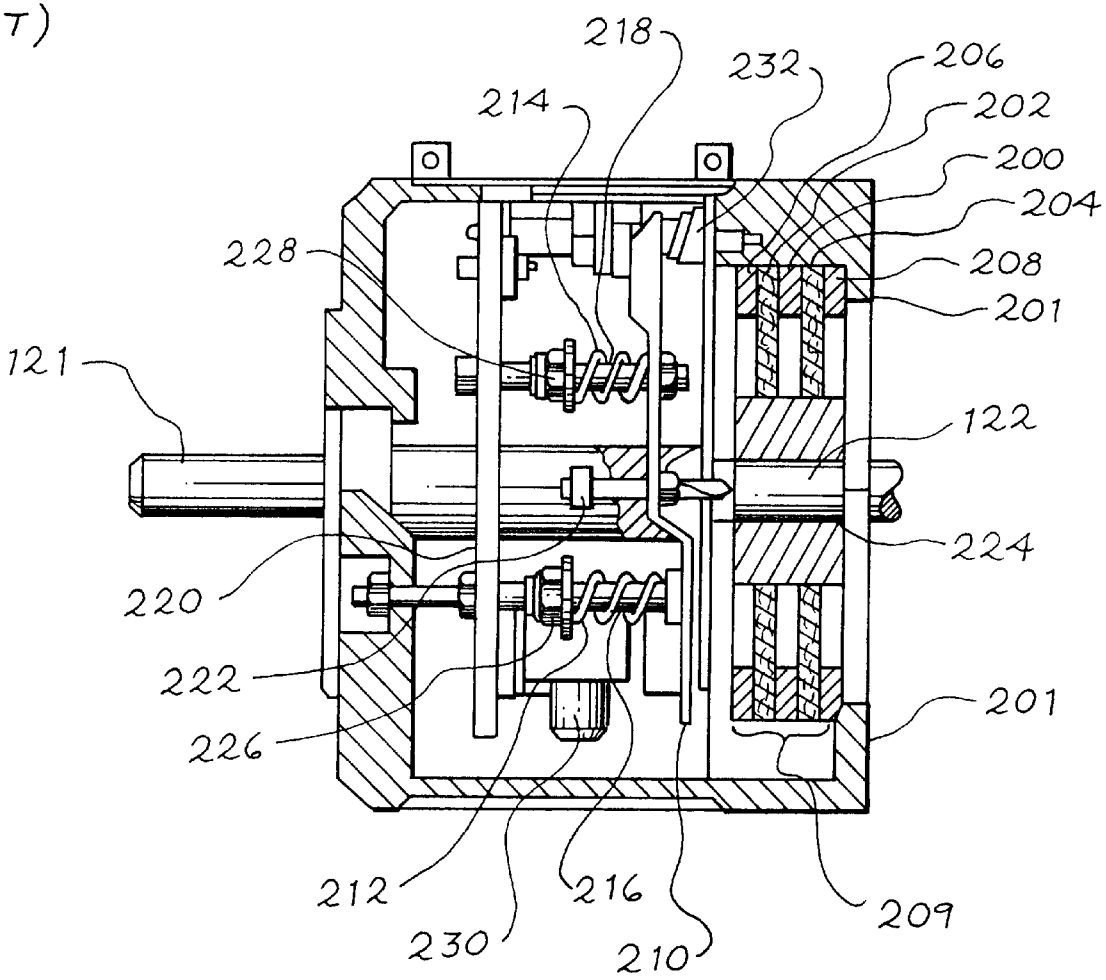
Fig. 5 (PRIOR ART)
FIG. 5 is a partial cross-sectional view of a motor brake as utilized in one embodiment of the present invention.

As shown in FIG. 5, brake 34 is a conventional electromagnetic disc brake. Motor shaft 122 is received by brake 34 and engages brake shaft 121. Motor shaft 122 is attached to disk 200, such that disk 200 rotates with motor shaft 122. Brake shoes 206 and 208 are located on either side of disk 200, but are not attached to motor shaft 122. Friction disk 202 is fixedly attached to brake shoe 206 and is located between disk 200 and brake shoe 206. Friction disk 204 is fixedly attached to brake shoe 208 and is located between disk 200 and brake shoe 208. Preferably, disk 200 and brake shoes 206 and 208 are made of a high-strength steel alloy and friction disks 202 and 204 are made of a steel impregnated asbestos material; however other similar types of materials could be used. Brake shoe 208 abuts housing 201, as will be described in detail below. Together, disk 200, friction disks 202 and 204 and brake shoes 206 and 208 form disk pack 209.

Armature plate 210 is biased toward brake shoe 206 by means of torque springs 212 and 214 which are supported by bolts 216 and 218. Bolts 216 and 218 pass through fixed plate 220 and armature plate 210. Two adjustment screws, only one of which is shown at 222, are threaded through armature plate 210 and retained by nut 224. An end of each adjustment screw is biased by the force of torque springs 212 and 214 into engagement with brake shoe 206, thus compressing disk pack 209. This results in brake shoes 206 and 208 frictionally engaging friction disks 202 and 204, respectively. When disk 200 is rotating (i.e., motor shaft 122 is rotating), this frictional engagement forces disk 200 to stop rotating, thereby braking the rotation of motor shaft 122 and brake shaft 121. The force placed on the disk pack 209 may be adjusted by turning locknuts 226 and 228 to adjust the length of torque springs 212 and 214, respectively. The force is selected to quickly stop rotation of motor shaft 122 when power is removed from motor M and to lock the motor shaft 122 when no power is applied to motor M.

Electromagnet assembly 230 is positioned between fixed plate 220 and armature plate 210. When power is applied to electromagnet assembly 230, a force sufficient to overcome the force of torque springs 212 and 214 is applied to armature plate 210, thus moving armature plate 210 into engagement with electromagnetic assembly 230 and away from disk pack 209. Adjustment screws 222 move away from and disengage brake shoe 206, thus substantially reducing the frictional force created between out plates 206 and 208 and friction disks 202 and 204. This results in release of the brake 34.

Figure 6:
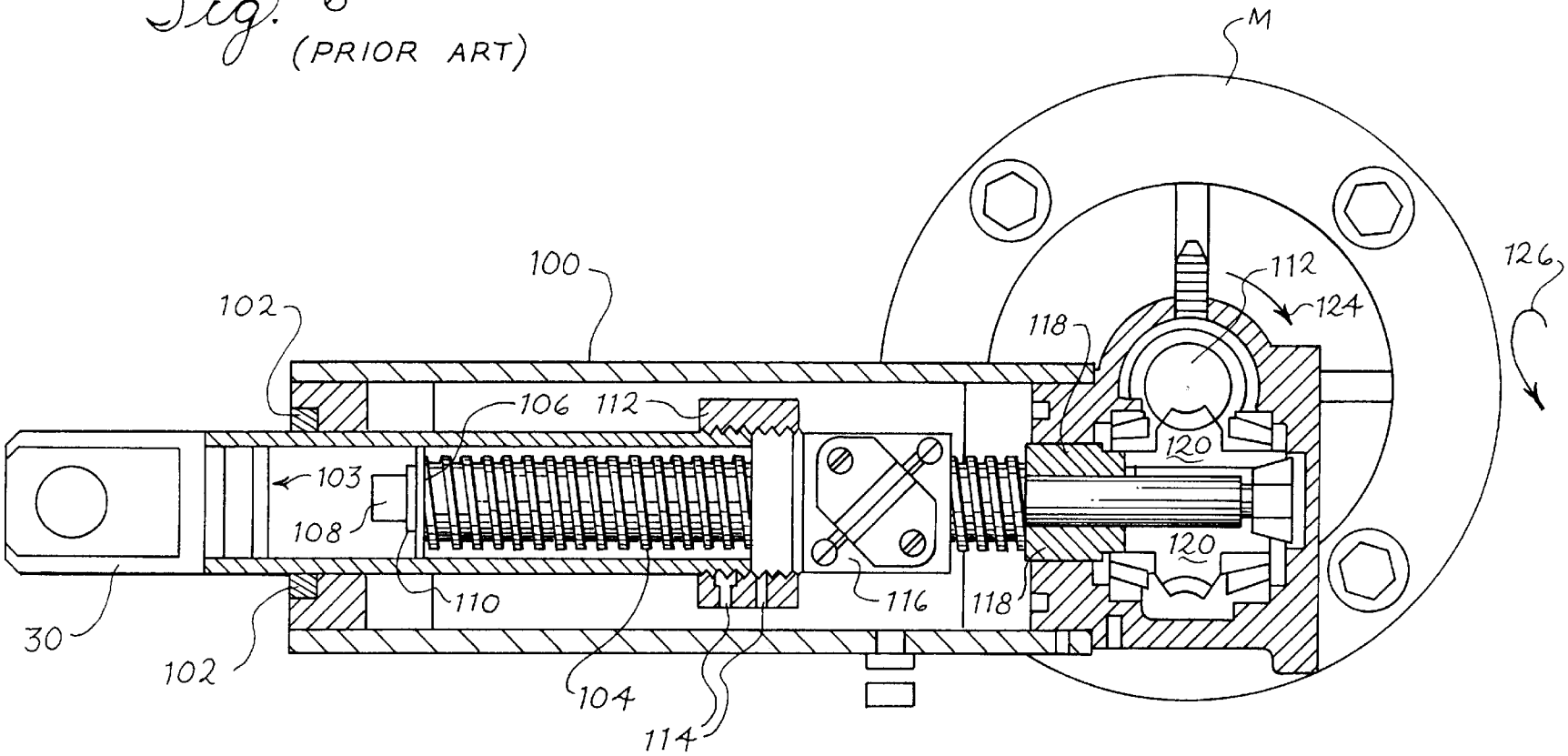
Fig. 6 (PRIOR ART)
FIG. 6 is a partial cross-sectional view of an actuator as utilized in one embodiment of the present invention.

Brake 34 may also be manually released by manually moving armature plate 210 away from disk pack 209. This can be accomplished by using a releasable wedging mechanism, not shown, which inserts a wedge at point 232 to move armature plate 210 away from disk pack 209. Such a mechanism is common in electromechanical braking systems of the type described herein. Actuator 32 is of conventional design. As shown in FIG. 6, actuator 32 includes cylinder housing 100 which receives actuator rod 30 via bushing 102. Rod 30 is bored up to surface 103 to receive threaded rod 104. Stop disk 106 is attached to the end of threaded rod 104 via socket head cap screw 108 and lock washer 110. Threaded coupling 112 is attached to the interior end of actuator rod 32 via set screws 114 and other set screws, not shown, spaced evenly about the coupling 112. Threaded rod 104 passes through threaded coupling 114 and ball nut 116 and narrows to a smooth shaft that passes through bushing 118. Threaded rod 104 terminates with longitudinal projections 120 even spaced about the periphery of its shaft. Longitudinal projections 120 engage threaded brake shaft 121 such that rotational movement can be transferred from brake shaft 121 to threaded rod 104.

In operation, when brake shaft 121 rotates in a clockwise direction as shown by arrow 124, threaded rod 104 rotates in a counterclockwise direction, as shown by arrow 126. As threaded rod 104 rotates in a counterclockwise direction, coupling 112 is forced toward bushing 102, thus forcing (i.e., extending) actuator rod 30 out of cylinder 100.

When brake shaft 121 rotates in a counterclockwise direction (i.e., opposite to the direction shown by arrow 124), threaded rod 104 rotates in a clockwise direction (i.e., opposite to the direction shown by arrow 126). As threaded rod 104 rotates in a clockwise direction, coupling 112 is forced in a direction away from bushing 102, thus pulling (i.e., retracting) actuator rod into outer tube 100.

As those of ordinary skill in the art will appreciate, by changing the direction of the threads on brake shaft 121 and/or threaded rod 104 and/or coupling 112, actuator rod 30 can be forced out of cylinder 100 when brake shaft 121 rotates in a counterclockwise direction and pulled into cylinder 100 when brake shaft 121 rotates in a clockwise direction. In addition, by changing the pitch of the threads on brake shaft 121 and/or threaded rod 104 and coupling 112, the speed at which actuator rod 30 is extended and retracted may be adjusted. Also, the speed of rotation of brake shaft 121 can be adjusted to adjust the speed at which actuator rod 30 is extended and retracted.

Actuator rod 30 is connected to lever arm 26 via bracket 33 and lever arm 26 is rotatably connected to handle 12 via shoulder bolt 28.

Operation of switch stand 10 is controlled by an operator using electrical control panel 36. Housing 38 encloses most of the switch stand 10. Control panel 36 is accessible through a small door in housing 38, not shown. Signal lights L1 and L2 are mounted on top of housing 38 and provide colored light. The color of light L1 matches one color of target 24 and the color of light L2 matches the other color of target 24. Lights L1 and L2 are controlled such that the illuminated light is that which matches the color of target 24 when viewed from the front. Other types of signal devices keyed to the operation of the target 24 can also be used, including audible signaling devices, colored display panels, directional arrows or other symbols, and blinking lights.

Figure 7:
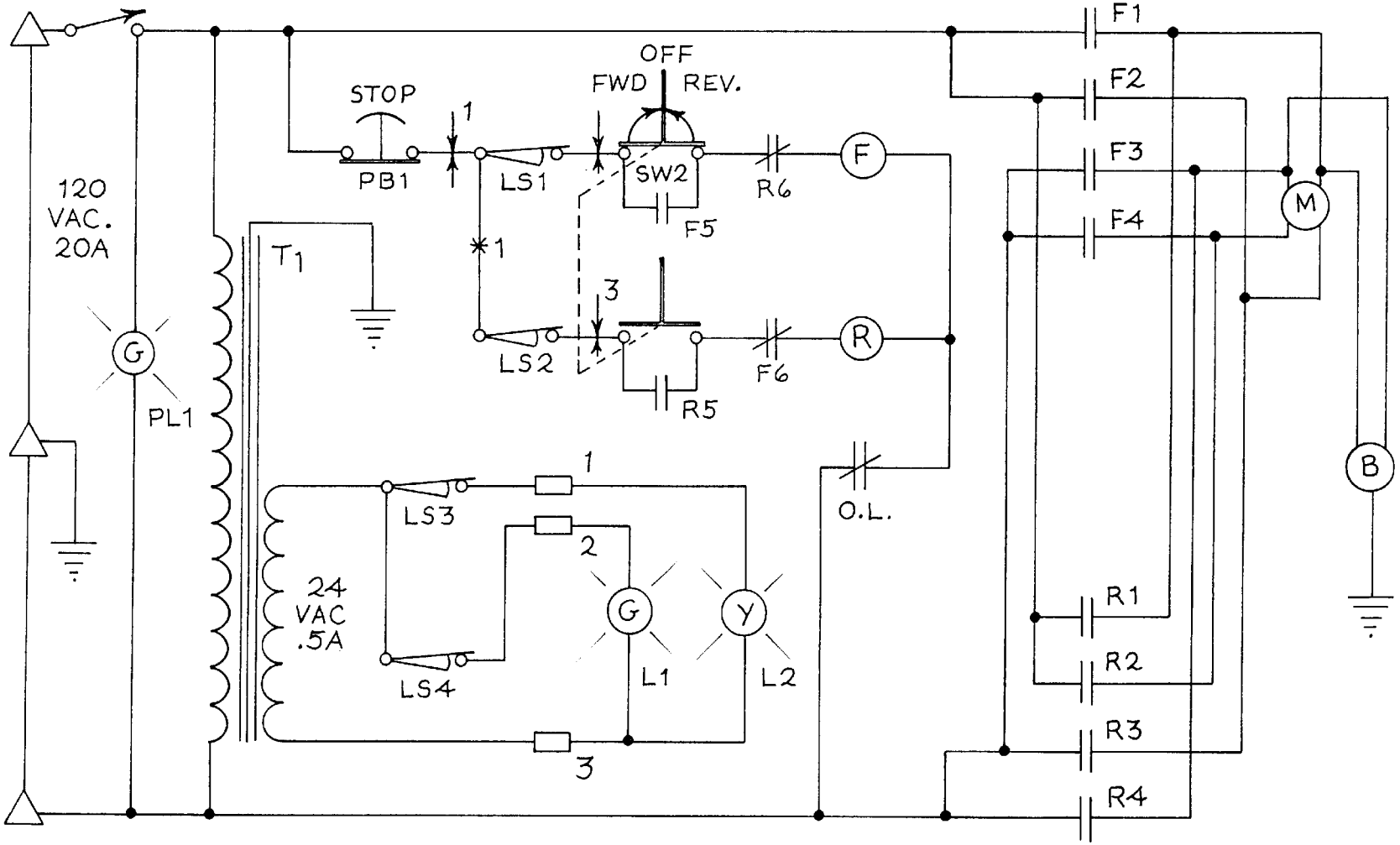
Fig. 7 (PRIOR ART)
FIG. 7 is an electrical schematic diagram for the electrical switch stand of FIG. 1.

A schematic diagram illustrating the connection of the electrical components of the switch stand 10 is shown in FIG. 7. In the embodiment illustrated in FIG. 7, the electrical system is powered by 120 VAC, the standard household consumer voltage, obtained by normal methods from a utility company. Other power sources, including solar power, battery power or a portable generator, may also be used to power the electrical system. Power switch SW1 is connected in series with the power source to control power to the entire electrical system. Pilot light PL1 is connected to switch SW1 and is energized when switch SW1 is closed. Motor M is connected via normally-open relay contacts F1, F2, F3, F4, R1, R2, R3, R4 to the power source. Motor brake release B is connected to the power source via relay contacts F1, F3, R1, R4. When relay contacts F1, F2, F3, F4 are closed, motor brake release B is energized and motor M rotates in a clockwise direction. When contacts R1, R2, R3, R4 are closed, motor brake release B is energized and motor M rotates in a counter-clockwise direction.

Relay F includes normally open contacts F1, F2, F3, F4, F5 and normally closed contact F6. Relay R includes normally open contacts R1, R2, R3, R4, R5 and normally closed contact R6.

One leg of the coil of relay F is connected to one side of the power source via overload circuit breaker OL, which opens when an overload condition is present. The other leg of the coil of relay F is connected to one side of normally closed relay contact R6. The other side of relay contact R6 is connected to relay contact F5 and one pole of a first set of contacts for push button switch SW2. Relay contact F5 is connected in parallel with the first set of contacts for push button switch SW2. Normally closed limit switch LS1 is connected in series with the parallel combination of push button switch SW2 and relay contact F5.

One leg of the coil of relay R is connected to one side of the power source via normally closed relay contact OL. The other leg of the coil of relay F is connected to one side of normally closed relay contact F6. The other side of relay contact F6 is connected to relay contact R5 and one pole of a second set of contacts for push button switch SW2. Relay contact R5 is connected in parallel with the second set of contacts for push button switch SW2. Normally closed limit switch LS2 is connected in series with the parallel combination of push button switch SW2 and relay contact R5. One pole of limit switch LS1 is connected to the corresponding pole of limit switch LS2 and to one pole of stop button PB1. The other pole of stop button PB1 is connected to one leg of the power source.

The voltage of the power source is stepped down from 120 VAC to 24 VAC via transformer T1. The stepped down voltage is applied to visual signal lights L1 and L2, via limit switches LS3 and LS4, respectively.

In operation, power switch SW1 is closed to provide power to the electrical system. When it is desired to throw the handle 12 from the first position to the second position, or from the second position to the first position, push button switch SW2 is turned in the proper direction and depressed. If the handle 12 is in the first position (i.e., resting in cradle 16), then limit switch LS1 is open and limit switch LS2 is closed. When push button switch SW2 is depressed in such a situation, the coil of relay F is energized and relay contacts F1, F2, F3, F4 and F5 are closed and relay contact F6 is opened, resulting in the locking in of power to the coil of relay F, the prevention of power being supplied to the coil of relay R, and the supplying of power to motor M so that motor M rotates in a clockwise, or forward, direction.

If the handle 12 is in the second position (i.e., resting in cradle 18), then limit switch LS2 is open and limit switch LS1 is closed. When push button switch SW2 is depressed in such a situation, the coil of relay R is energized and relay contacts R1, R2, R3, R4 and R5 are closed and relay contact R6 is opened, resulting in the locking in of power to the coil of relay R, the prevention of power being supplied to the coil of relay F, and the supplying of power to motor M so that motor M rotates in a counterclockwise, or reverse, direction.

The motor M may be stopped at any time by pushing stop button PB1, which opens the circuit providing power to the coil of relay F or the coil of relay R.

When the handle 12 is in the first position, target 24 is in its first position and limit switch LS3 is open. Under those conditions, light L1 is lit and light L2 is unlit. When the handle 12 is in the second position, target 24 is in its second position and limit switch LS4 is open. Under those conditions, light L2 is lit and light L1 is unlit. As shaft 22 rotates, neither limit switch is open and both light L1 and light L2 are lit. In an alternative embodiment, lights L1 and L2 are never lit at the same time and are only lit when a corresponding limit switch is being engaged.

Switch stand 10 may also be operated manually in the event there is an electrical power failure or other type of emergency situation. Manual operation is effected by manually releasing brake 34 and attaching a crank (not shown) to the upper end of motor shaft 122 by passing the shaft of the crank through opening 40. The upper end of motor shaft 122 can be formed to have a polygonal cross section, thus allowing it to be received by a mating polygonal bore in the handle. Other types of attachment mechanisms known to those of ordinary skill in the art may also be used. Once attached to motor shaft 122, the crank handle can be turned in either a clockwise or a counterclockwise direction to effect movement of handle 12 and actuation of switching mechanism 14.

Handle 12 may also be manually operated directly by removing shoulder bolt 28 and thereby disconnecting handle 12 from lever arm 26. Handle 12 may then be manually moved between the first position and the second position to actuate the switching mechanism 14.

Switch stand 10 may also be operated by remote control by employing known RF or infrared transmitters and receivers and electronic switching technology to replace or supplement switches SW1, SW2, PB1. Technology found in common remote control garage door openers or television remote controls can be employed for such a purpose in a manner known to those of ordinary skill in the art.

FIGS. 8–11 show one embodiment of the electrical switch stand of the previous FIGS. 1–4 modified and configured according to the present invention. Reference will be made to these Figures using identical reference numerals to refer to identical components, with an initial digit of "4" added to each.

An electrical switch stand 410 is shown in the Figures having a housing 438 containing a switching mechanism 414 which is identical to that shown in FIGS. 1–6. Conventional switching mechanism 414 is positioned near the rear of the housing 438, and is operable to move the conventional connecting rod 420 projecting from the base of the housing 438. A shaft 422 extends upwardly from the switching mechanism 414. As in the previous embodiments, a target 424 is attached to shaft 422 to indicate the position of the switching mechanism 414.

In the preferred embodiment, a conventional gear-reduction mechanism is utilized to directly drive the operating shaft 474 of the switching mechanism 414. As in the embodiments shown in FIGS. 1–6, the operating shaft 474 is preferably connected to a handle 412 for movement between a first position at cradle 416 to a second position at cradle 418 to operate the connecting rod 420.

Figure 8:
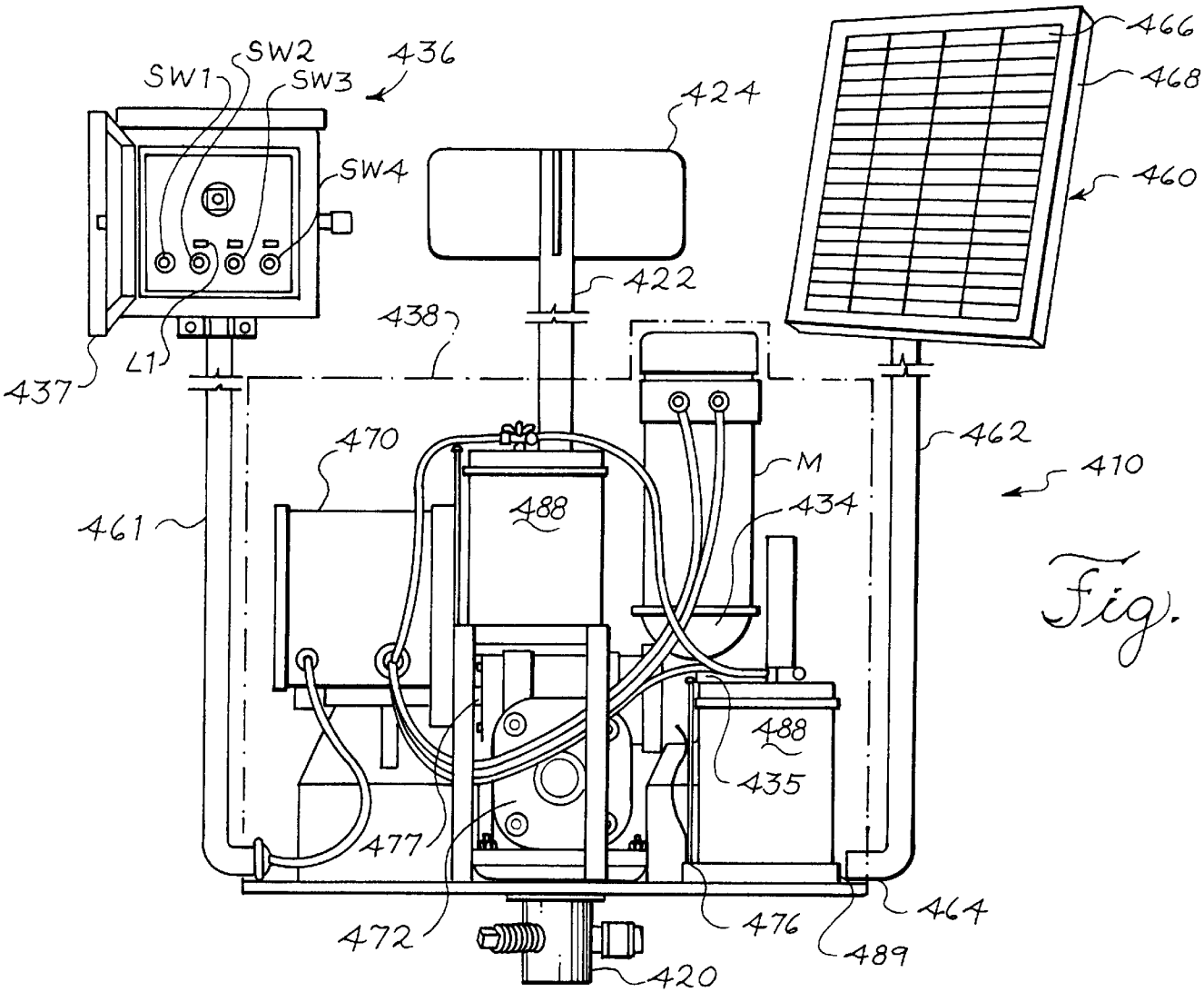
FIG. 8 is a front cross-sectional view of a solar-powered electrical switch stand embodying the present invention.
Figure 9:
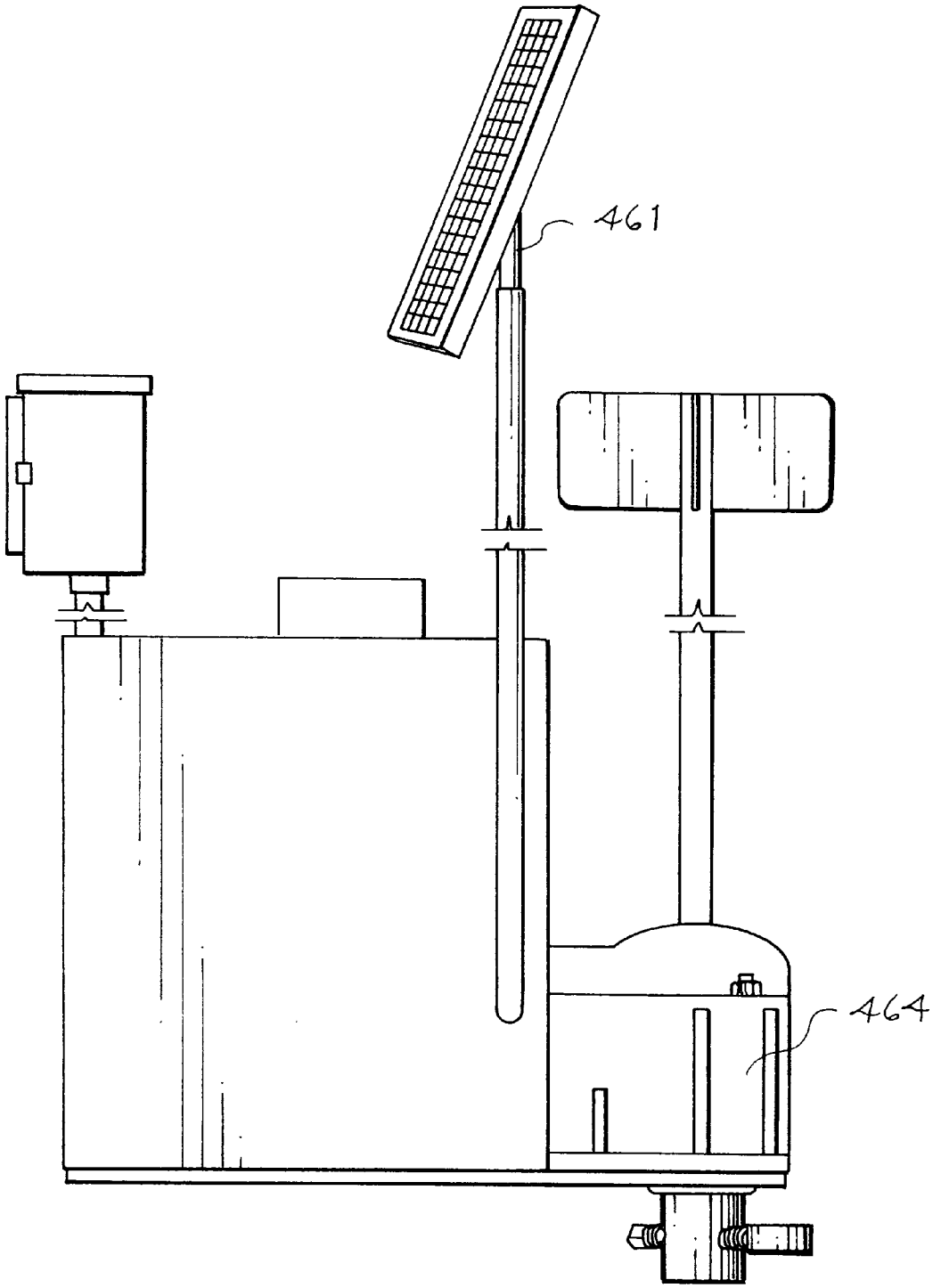
FIG. 9 is a side elevational view of the solar-powered electrical switch stand of FIG. 8.
Figure 10:
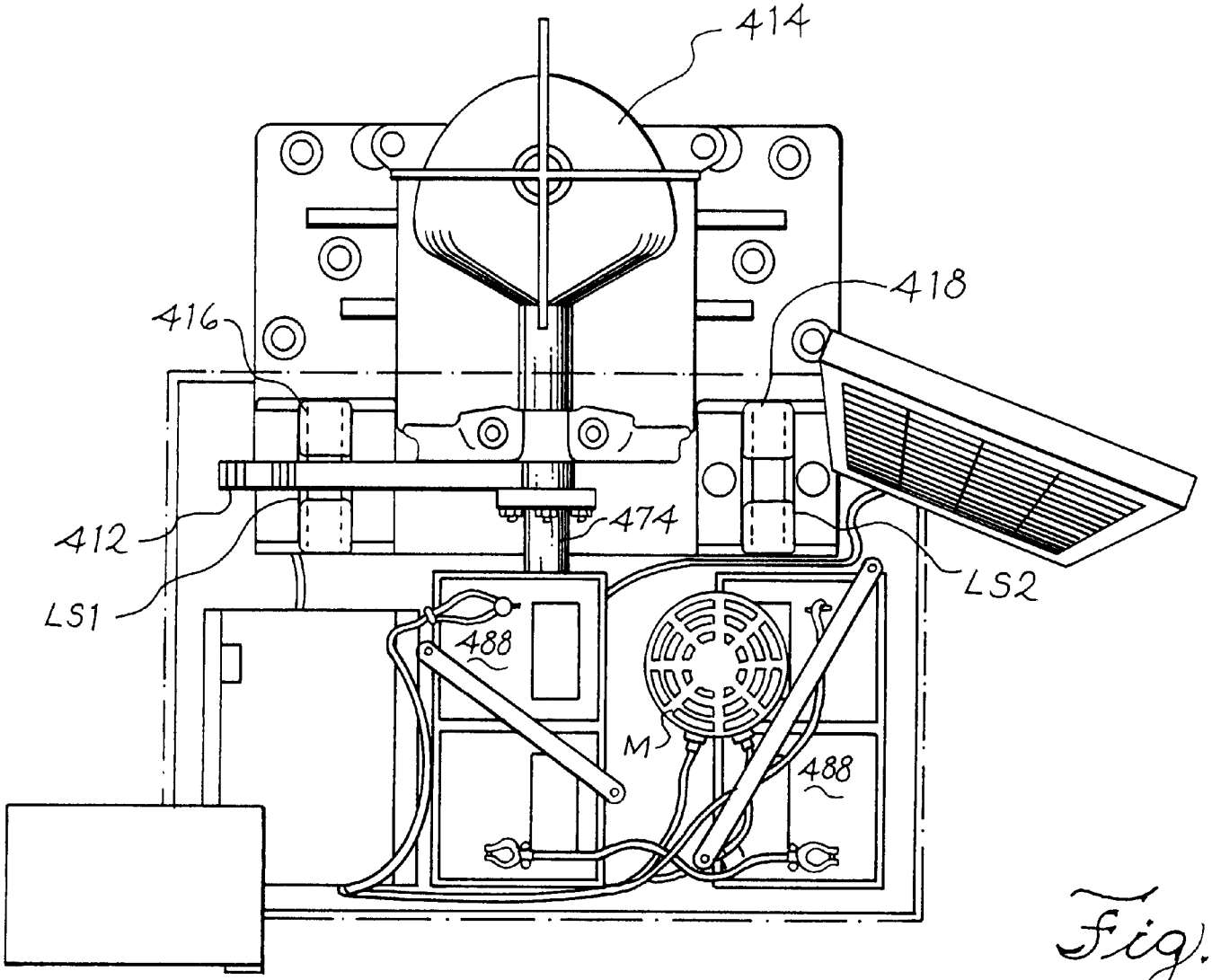
FIG. 10 is a top, partial cross-sectional view of the solar-powered electrical switch stand of FIG. 8.

The handle 412 and operating shaft 474 are operated by a motorized drive system. As shown in FIG. 8, a 24-Volt D.C. motor M turns the drive shaft 435. The drive shaft 435 is connected to a transverse drive assembly 476. The drive assembly 476 translates the vertical rotation of the motor shaft to a horizontally oriented drive shaft 542. The gear box 472 includes a compound gear train transmission including a reverted gear train. Such a device may be a double-reduction type manufactured by Euclid-Hampton Company located in Bedford, Ohio or Portland, Oreg.

Figure 11:
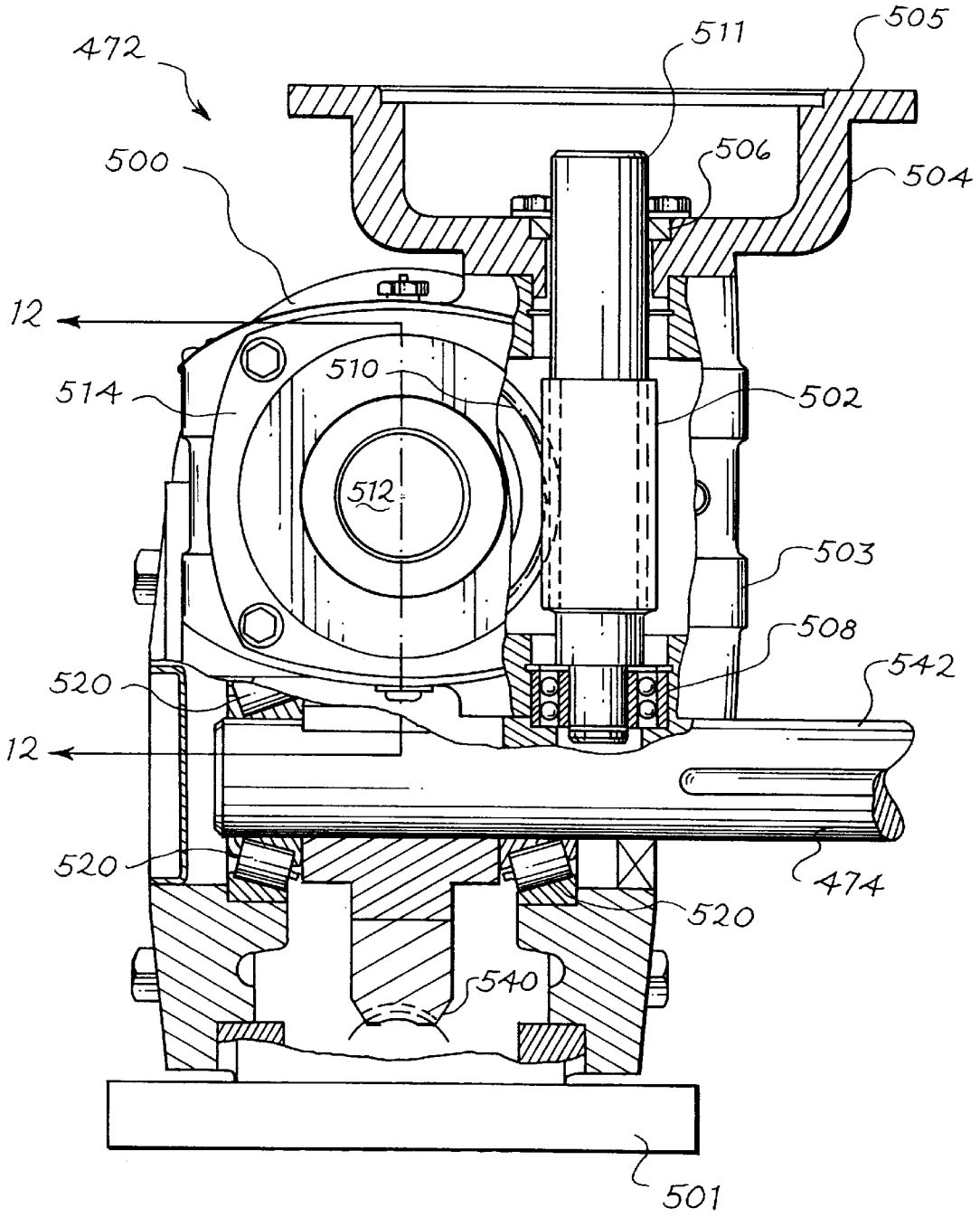
FIG. 11 is a side, partial cross-sectional view of the gear-reduction unit utilized in the invention of FIG. 8.
Figure 12:
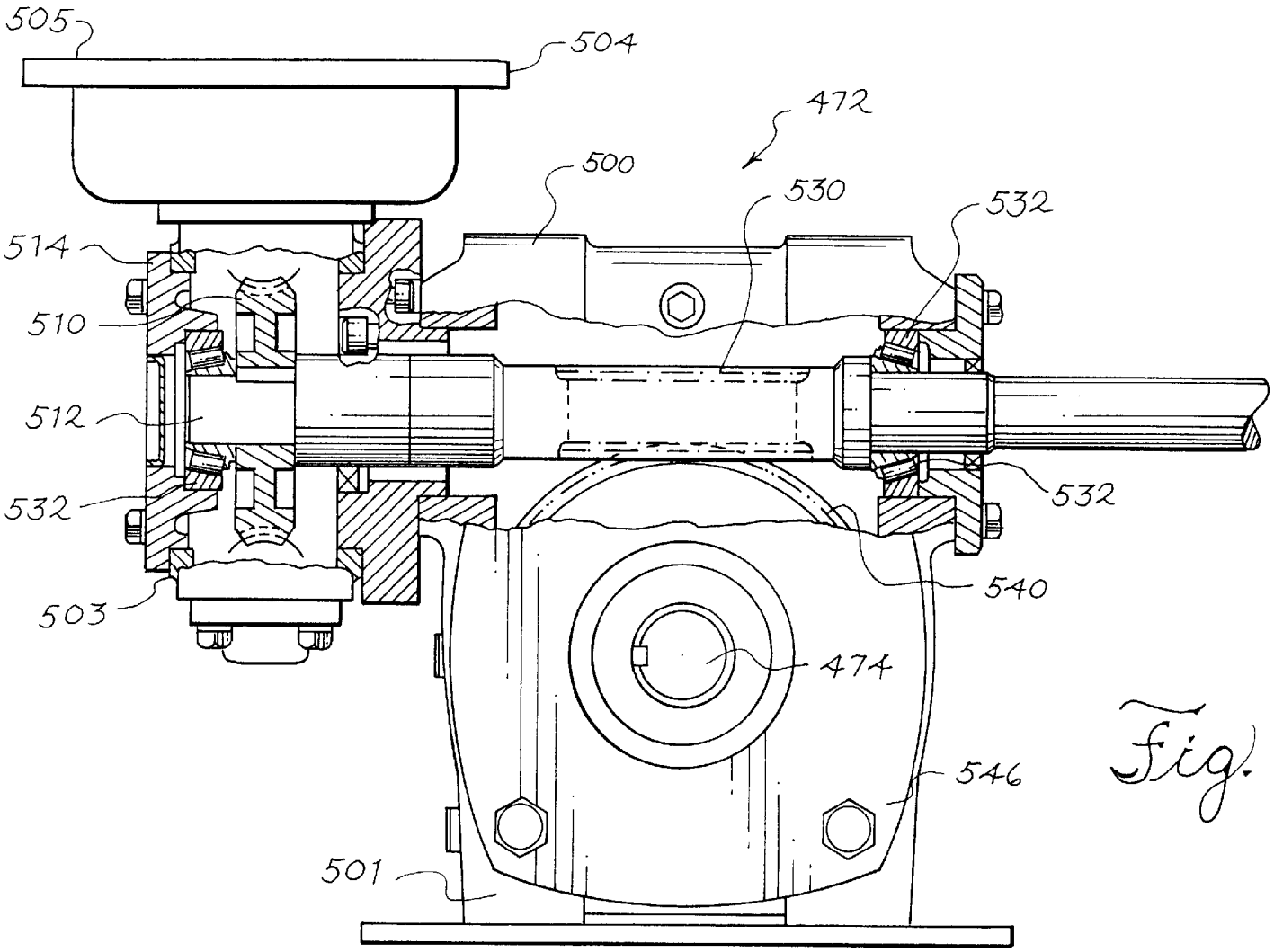
FIG. 12 is a side, partial cross-sectional view of the gear-reduction unit of FIG. 11, taken along the line 12—12.

The gear box 472 utilized in the preferred embodiment is shown in detail in the drawings of FIGS. 11 and 12. As shown in the figures, the gear box 472 includes a transverse housing 500 rigidly mounted to a vertical housing 503. The lower portion of the housing 500 preferably forms a base 501 for attaching the gear box 472 to the switch stand 410. The drive shaft 435 of the motor M is axially aligned with a vertical input shaft 511. The motor M may be mounted over the input shaft 511 via mounting bracket 504, which includes mounting flanges 505. The input shaft 511 is rotationally held within the vertical housing 503 via a set of roller bearings 506 on the upper portion and 508 on the lower portion, to allow free rotation of the shaft 511 relative to the housing 503. A worm 502 extends along the central portion of the shaft 511 and is preferably rigidly connected thereto. The worm 502 intermeshes with a partially-enveloping worm gear 510 mounted. The worm gear 510 is axially mounted to a transverse shaft 512 which extends axially within transverse housing 500. The shaft 512 is mounted for free rotation relative to the housing 500 via a set of roller bearings 532 affixed to the ends of the shaft of 512 and portions of the transverse housing 500 and the side of the vertical housing 503. The end bearing 532 of the transverse shaft 512 is retained within the housing 500 by a bolted retaining cover 514. The rotational speed of the shaft 512 is thereby reduced by the worm and worm-gear combination.

The transverse drive shaft 512 is mounted to a worm 530 extending along the axis of the transverse drive shaft 512. The worm 530 mates with a larger worm gear 540, which is mounted to an operating shaft 474. The operating shaft 474 is mounted within the housing 500 via a pair of bearings 520, and extends at an angle of 90° relative to both the transverse shaft 512 and the vertical shaft 511. A rear portion 542 of the operating shaft 474 extends outwardly from the housing 500 for connection with the switching mechanism 414 on the switch stand 410. The opposite end portion of the shaft 474 is retained in the housing 500 by a bolted housing cover 546.

One skilled in the art would readily realize that the tooth members, gear diameters, pitch and worm thread dimensions for worms 530 and 502 and worm gears 510 and 540 may be of varying dimensions, and a variety of dimensions may be provided in order to accomplish the desired speed, reduction and torque generation.

The gear box 472 reduces the r.p.m. of the motor so that the transverse shaft 542 turns at approximately 5 r.p.m. at full speed. The torque developed on the operating shaft 474 is approximately 3120 lb-in., which is sufficient to turn the operating shaft 474 to operate the switching mechanism 414. Reversing of the switching operation is preferably accomplished by switching the poles of the supply leads to motor M, as described in connection with the circuit diagram below.

In the alternative, the electrical switch stand 410 may utilize a switching mechanism similar to that shown in FIGS. 1–6. In particular, motor M may drive motor brake 434 which may in turn drive conventional cylinder and linear actuator assembly (not shown).

In the present embodiment, the electrical system of the switch stand 410 is powered by two 12-volt wet-cell batteries 488 which are charged by a solar cell charging system. The batteries 488 are preferably model 135AH manufactured by Batteries Plus®, and have an output current of 24 volts, and 270 Amp-Hours combined. The batteries 488 are preferably charged via a solar cell charging system as described below.

A solar panel 460 is supported by hollow mounting post 462 above the housing 438. The solar panel 460 includes a rigid rectangular and planar substrate 468 on which are mounted a plurality of interconnected solar cells 466. The individual solar cells are preferably of a single crystal silicon type manufactured by Solar World, Inc.® of Denver, Colo. Each of the cells 466 produces 15.625 mA of current and are linked in series to produce a total current of 1 AMP at 36 volts. In the preferred embodiment, 64 cells are used and the solar panel 460 has a total surface area of 18"×24".

The solar panel 460 is preferably mounted to the mounting post 462 via an adjustment means 461, which allows the solar panel 460 to swivel relative to the post 462. The post 462 is preferably a length of rigid 1½ inch metal conduit to elevate the solar panel sufficiently above the housing 438. The adjustment means can be a turnable swivel joint to allow 360 degree rotation of the panel 460. In the alternative, the adjustment means 461 may comprise a universal ball joint that can allow rotation and elevation of the solar panel 460. The adjustment means 461 allows the solar panel 460 to be rotated to a position wherein a maximum amount of sunlight may be absorbed by the solar cells 466 for a given position of the sun relative to the housing 438. Preferably, however, the panel 460 is maintained at an angle of 45 degrees to the horizontal. This position has been found to be the most effective in maximizing the current output from the panel in the present system.

The solar panel 460 may also be mounted relative to the housing 438 by a tracking system which utilizes a motor to rotate or move the panel 460 to track the position of the sun to maximize sunlight exposure throughout the daylight hours. The tracking system may include a timing motor mounted to the post 462 that rotates the panel 460 throughout an arc of 360 degrees. The system may utilize photosensors to determine a position in which the most direct sunlight may be received. Such systems are conventionally available through manufacturers such as Solar World, Inc.@ of Denver, Colo.

The leads 489 from the solar cell assembly 460 are connected in parallel with the two batteries 488 via a junction control box 470. When the solar cell assembly is exposed to sunlight and generating electrical current, the current trickle-charges the batteries. Preferably, the solar cell assembly 460 will produce at least 650–750 mA of current to charge and maintain a charge in the batteries 488.

The operation and control of the switch stand 410 is accomplished via a raised control panel 436. As best seen in FIG. 8, the control panel 436 is preferably supported above the housing 438 by a mounting rod 461. A hinged door 437 protects the interior controls and indicators from precipitation and dirt. Various signal lights L1 may be provided adjacent the interior controls to indicate the position and status of the various components in the system. Pushbutton switches SW1–SW3 are preferably mounted in the control panel 436. SW1 is a power switch, SW2 moves the handle 412 of the switching mechanism 414 in the reverse direction to position 1, SW3 moves the handle 412 in the forward position to position 2, and switch SW4 is an emergency stop switch.

Figure 13:
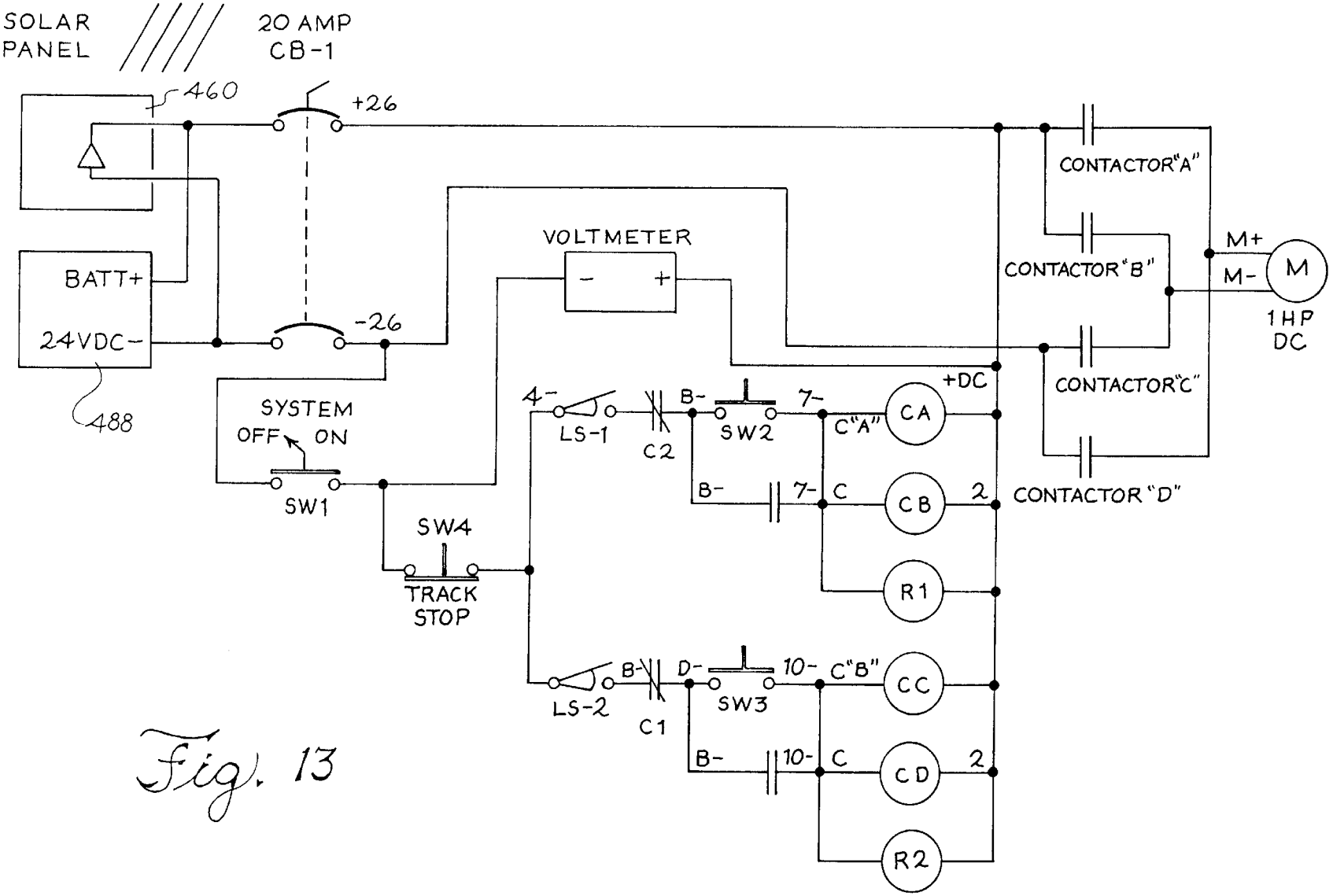
FIG. 13 is an electrical schematic diagram for the solar-powered electrical switch stand of FIG. 8.

A schematic diagram illustrating the remaining electrical components of the switch stand 410 is shown in FIG. 13. The circuit shown in FIG. 13 is preferably mounted within the junction control box 470. Batteries 488 are charged by the solar cell assembly 460. The batteries 488 each input 12 volt DC power to the system for a total of 24 volts. Power switch SW1 is connected to the batteries 488 to control power to the electrical system. The 24 volt DC motor M is connected via normally open solenoid contacts A, B, C and D to the batteries 488 as shown. When these contacts are closed, the positive and negative poles are switched and the motor M may run in either a reverse or forward direction. In particular, when A and B are closed, the motor M shaft runs in a clockwise direction. If C and D are closed, the motor M runs in the shaft in the counter-clockwise direction.

The solenoid coil CA includes normally open contacts A and solenoid coil CB includes normally open contact B. Coils CC and CD include normally open contacts C and D, respectively. The solenoid coil C includes normally open contact R1 and the solenoid coil C includes normally open contact R2.

Normally closed limit switches LS1 and LS2 are connected in series with the normally closed contacts C1 and C2 and the solenoid coils CA and CB, respectively. The "Forward Start" SW3 and "Reverse Start" SW2 normally open pushbutton switches are also connected in series with the coils CA, CB and R1, and CC, CD and R2, respectively. Linked in parallel with the start switches are contacts MF14 and MR14, which are linked in series with the coils R1 and R2. Contacts T1 and T2 are responsive to coils R1 and R2, respectively.

During operation of the system, power switch SW1 is closed to provide power to the electrical system. When it is desired to throw the handle 412 from the first position to the second position, or from the second position to the first position, pushbutton switch SW2 or SW3 is depressed to close the circuit to the coil CA or CB. If the handle 12 is in the first position (i.e., resting in cradle 416), then limit switch LS2 is open and limit switch LS1 is closed. When switch SW2 is depressed in such a situation, the coil CA is energized and contact A is closed, and coil CB is energized and contact B is closed. Coil R1 is also energized, and this opens contact C1, which locks in power to relay coil CA, CB and R1 and prevents power from being supplied to coil CC. Power is thus supplied through contacts A and B to the motor M and the handle operating shaft 474 is turned until the handle 412 rests in cradle 418. In this position, limit switch LS1 opens to release power to coil CA. The motor M may be stopped at any time by pushing the stop button SW4, which opens the circuit providing power to the coils MF or MR.

In the event that ballast or other debris is caught between the switch rails and the connecting rod 420 cannot be fully actuated, a manual-resetable, conventional 20-AMP circuit breaker CB1 is provided to prevent overloading of the internal mechanical or electrical components of the system. The system fully opens the power leads upon detection of overload.

As with the previous embodiments, the switch stand 410 may be operated manually in the event of battery failure or other situation. Manual operation may be performed by releasing the gearbox 472 from the operating shaft 474 and throwing the handle 412 manually between cradle positions. In the alternative, the gearbox 472 may be left connected to the operating shaft 474 and the motor shaft may be turned manually via a crank (not shown) attached to the gear box 472.

Also, the switch stand 410 may be operated by remote control by employing the transmitter systems discussed previously.

Of course, it should be understood that a wide range of changes and modifications can be made to the embodiment of the method described above. It is therefore intended that the foregoing detailed description be regarded as illustrative rather than limiting and that it be understood that it is the following claims, including all equivalents, which are intended to define the scope of this invention.

While various forms and modifications have been described above and illustrated in the drawings, it will be appreciated that the invention is not limited thereto but encompasses all variations and expedients within the scope of the following claims.

What is claimed is:

1. A solar-powered electrical switch stand for moving the switching rails of a railroad track, said switch stand comprising:

a housing attached to a base, said housing enclosing a motor having a vertically oriented input shaft, said input shaft including a worm rigidly mounted thereto, said worm engaging a worm gear axially mounted to a transverse shaft extending transversely to said input shaft, said transverse shaft being linked to an operating shaft extending from said housing, said operating shaft being linked to an operating means for moving said switching rails;

a mounting rod upstanding from said housing;

a solar cell assembly supported by said mounting rod above said base and said housing, said solar cell assembly including a substantially flat panel incorporating an array of solar cells; and a power supply circuit contained within said housing and connected to said solar cell assembly, said circuit including a control means, at least one activation switch, and at least one storage battery;

wherein said solar cell assembly collects radiant energy from sunlight for charging said storage battery, said storage battery for supplying power to said motor to operate said gear-reduction means and said operating means.

2. The switch stand of claim 1 further comprising adjustment means mounted to said solar cell assembly for moving said solar cell assembly relative to said housing.

3. The switch stand of claim 2 wherein said storage battery further comprises at least one rechargeable wet-cell battery.

4. The switch stand of claim 3 wherein said control means further comprises a plurality of relay contacts for controlling the rotational direction of said motor shaft.

5. The switch stand of claim 4 further comprising a handle means attached to said operating means, said handle means movable from a first position to a second position.

6. The switch stand of claim 5 wherein said operating shaft is attached to said handle means, said operating shaft being configured to turn a connecting rod linked to said switching rails.

7. The switch stand of claim 1 further comprising signal indicating means for displaying the switching status of said switch means.

8. The switch stand of claim 1 wherein said operating shaft is configured to turn a connecting rod linked to said switching rails.

9. An electrical railroad switch stand for moving switching rails of a railroad track comprising:

(a) switch means for switching rails of a railroad track;

(b) solar cell means elevated above said housing means, said solar cell means for collecting radiant energy;

(c) battery means electrically coupled to said solar cell means;

(d) control circuit means electrically coupled to said battery means;

(e) motor means electrically coupled to said control circuit means, said motor means including a motor shaft; said motor shaft rotatable in a first direction and in a second direction;

(f) a vertically oriented input shaft, said input shaft including a worm rigidly mounted thereto, said worm engaging a worm gear axially mounted to a transverse shaft extending transversely to said input shaft, said transverse shaft being linked to an operating shaft extending from said housing: and (g) brake means coupled to said operating shaft for stopping rotation of said motor shaft, said brake means including a brake shaft.

10. The railroad switch stand of claim 9 further including signal indicating means for displaying the switching status of said switch means.

11. The railroad switch stand of claim 10 further including means for manually actuating said switch means.

12. The railroad switch stand of claim 10 wherein said means for controlling the rotation of said motor shaft includes electrical switch means.

13. A method for moving switching rails of a railroad track, said method comprising the steps of:

providing a housing;

enclosing, in said housing, a motorized switching means including an electric motor and a control switch connected to said motor, said motor having a vertically oriented input shaft that includes a worm rigidly mounted to said input shaft, said worm engaging a worm gear axially mounted to a transverse shaft extending transversely to said input shaft, said transverse shaft being linked to an operating shaft extending from said housing;

linking said operating shaft to switching rails;

providing a rechargeable battery means electrically coupled to said motorized switching means;

providing a solar cell means mounted to said housing and electrically coupled to said battery means for generating power from sunlight;

transmitting power from said solar cell means to said battery to charge said battery means; and triggering said actuation switch to energize said motor said switching means, thereby causing said switching means to move said switching rails.

14. The method of claim 13 further comprising the step of positioning said solar cell means in a first position to receive sunlight.

15. The method of claim 14 further comprising the step of repositioning said solar cell means to a second position to receive sunlight, said second position aligning said solar cell means closer to parallel to the direction of the sun than said first position.

16. The method of claim 15 wherein said step of repositioning said solar cell means is performed by operating an electric motor means to rotate said solar cell means relative said housing.

17. The method of claim 14 further comprising the step of tracking the position of the sun relative to said solar cell means by moving said solar cell means relative to said switching means.

18. The method of claim 13 wherein said battery means further comprises two twelve-volt rechargeable batteries.

19. The method of claim 13 wherein said solar cell means further comprises a panel of electrically connected solar cells elevated above said switching means.

20. The method of claim 13 further comprising the step of tracking the position of the sun relative to said solar cell means by moving said solar cell means relative to said switching means.

* * * * *

UNITED STATES PATENT AND TRADEMARK OFFICE

CERTIFICATE OF CORRECTION

PATENT NO. : 6,042,060
DATED : March 28, 2000
INVENTOR(S) : Isaac Sargis

It is certified that error appears in the above-identified patent and that said Letters Patent is hereby corrected as shown below:

Title page,
ABSTRACT,
Column 2,
Lines 2, 5, and 8, change "mechanism" to -- means --.
Line 9, change "device" to -- means --.

Claim 9,
Line 19, change ":" (colon) to -- ; -- (semicolon).

Claim 13,
Line 21, after "motor" insert -- of --.

Signed and Sealed this

Twenty-fifth Day of December, 2001

*Attest:*

*Attesting Officer*

JAMES E. ROGAN
*Director of the United States Patent and Trademark Office*